US006024319A

United States Patent [19]

Kawabata et al.

[11] Patent Number: 6,024,319

[45] Date of Patent: Feb. 15, 2000

[54] TENSION CONTROL APPARATUS

[75] Inventors: Saburo Kawabata; Shigeru Suemori, both of Yokohama, Japan

[73] Assignee: Sumitomo Electric Industries, Ltd., Osaka, Japan

[21] Appl. No.: 09/056,936

[22] Filed: Apr. 8, 1998

[30] Foreign Application Priority Data

Apr. 9, 1997 [JP] Japan ..... 9-091102

[51] Int. Cl.[7] ..... B65H 77/00; B65H 59/38

[52] U.S. Cl. ..... 242/417.3; 226/44; 226/118.3; 242/154; 242/420.6

[58] Field of Search ..... 242/417, 417.3, 242/418.1, 419.7, 420.6, 154; 226/44, 118.3, 195

[56] References Cited

U.S. PATENT DOCUMENTS

| | | | |
|---|---|---|---|
| 2,006,819 | 7/1935 | Zschach | 242/420.6 |
| 3,331,568 | 7/1967 | Okamura | 242/154 |
| 3,836,089 | 9/1974 | Riemersma | 242/417.3 |
| 4,012,003 | 3/1977 | Cochran et al. | 242/420.6 X |
| 4,260,116 | 4/1981 | Collin | 242/417.3 |
| 5,100,074 | 3/1992 | Jones | 242/420.6 |
| 5,119,982 | 6/1992 | Hutzenlaub | 226/44 |
| 5,546,993 | 8/1996 | Summey, III et al. | 226/44 X |

FOREIGN PATENT DOCUMENTS 6-255885 9/1994 Japan .

*Primary Examiner*—Michael R. Mansen
*Attorney, Agent, or Firm*—Pillsbury Madison & Sutro LLP

[57] ABSTRACT

A tension control apparatus includes at least two guide rollers and at least one dancer roller disposed so as to be movable relative to said guide rollers, and applies a predetermined amount of tension to a linear body wound about the guide rollers and dancer roller. This apparatus has a tension control device for variably controlling the tension applied to the linear body by adjusting an angle between a vertical line and a line connecting respective rotational centers of the guide rollers and dancer roller.

10 Claims, 11 Drawing Sheets

Va : FEEDING SPEED
Vb : DISCHARGING SPEED

TENSION CONTROL APPARATUS

BACKGROUND OF THE INVENTION

1. Field of the Invention

The present invention relates to a tension control apparatus using a dancer roller device which applies tension to a linear body such as an optical fiber and a wire.

2. Related Background Art

Conventionally known as a tension control apparatus for a linear body is the one disclosed in Japanese Patent Application Laid-Open No. 6-255885. As shown in FIG. 12, this apparatus comprises guide rollers 2 and dancer rollers 3, about both of which a running linear body 10 is wound. The dancer rollers 3 are installed so as to be movable relative the stationary guide rollers 2 approximately in the vertical directions (along a line connecting the respective rotational center axes of the guide rollers 2 and dancer rollers 3), and apply the predetermined amount of the tension to the linear body 10 by holding the dancer rollers 3 at a predetermined position (control midpoint position). For this tension adjustment, the tension control apparatus comprises a torque motor 102 for variably controlling the tension applied to the linear body 10, an arm 4 for applying a moment produced by a torque of the torque motor 102 to dancer rollers 3, a tension detector 91 for detecting the tension of the linear body 10, and a tension control means 100 for receiving an output signal of the tension detector 91 and supplying a drive signal to the torque motor 102.

SUMMARY OF THE INVENTION

The conventional tension control apparatus, however, is disadvantageous in that it incurs a high installation cost. Namely, this tension control apparatus necessitates a number of instruments such as a torque motor, tension control means for supplying a drive signal to the torque motor, and the like in addition to the existing dancer roller device, thereby making it necessary to substantially modify the dancer roller device. In particular, when a multifiber cable or the like is to be produced, it is necessary to control tension for each of the multiple fibers. In the case where this technique is employed, a torque motor and the like must be provided for each fiber, whereby there is a possibility of the apparatus becoming enormous, arrangement of the linear body difficult, and the tension control more difficult.

In order to overcome problems such as those mentioned above, it is an object of the present invention to provide a tension control method and an apparatus having a simple configuration which can assure variable control of a tension of a linear body.

Therefore, the tension control apparatus in accordance with the present invention comprises at least two guide rollers and at least one dancer roller disposed so as to be movable relative to the guide rollers, and applying a predetermined amount of tension to a linear body wound about the guide rollers and dancer roller, and further comprises tension control means for variably controlling the tension applied to the linear body by adjusting an angle between a vertical line and a line connecting respective rotational centers of the guide rollers and dancer roller.

A predetermined force due to the dead weight of the dancer roller and the like as adjusted by the following mechanism provides a tension to the linear body wound about the guide rollers and dancer roller. The force caused by the dead weight and the like acts vertically. The magnitude of the component of this force in the direction of the line connecting such rotational centers can be altered by changing an angle between the vertical line and a line connecting the respective rotational centers of the guide rollers and dancer rollers. The tension applied to the linear body depends on thus directed component of force and, accordingly, can be controlled easily.

In a variable tension control, the feeding and discharging speeds of the linear body with respect to the guide rollers and dancer rollers may be minutely adjusted so as to alter the relative position of the dancer rollers with respect to the guide rollers.

In accordance with the present invention, without addition of specific devices such as a torque motor, the tension of the linear body can be variably controlled to a predetermined amount.

In order to move the relative position of the dancer roller with respect to the guide roller, the dancer roller may be moved horizontally and/or vertically relative to the guide roller.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
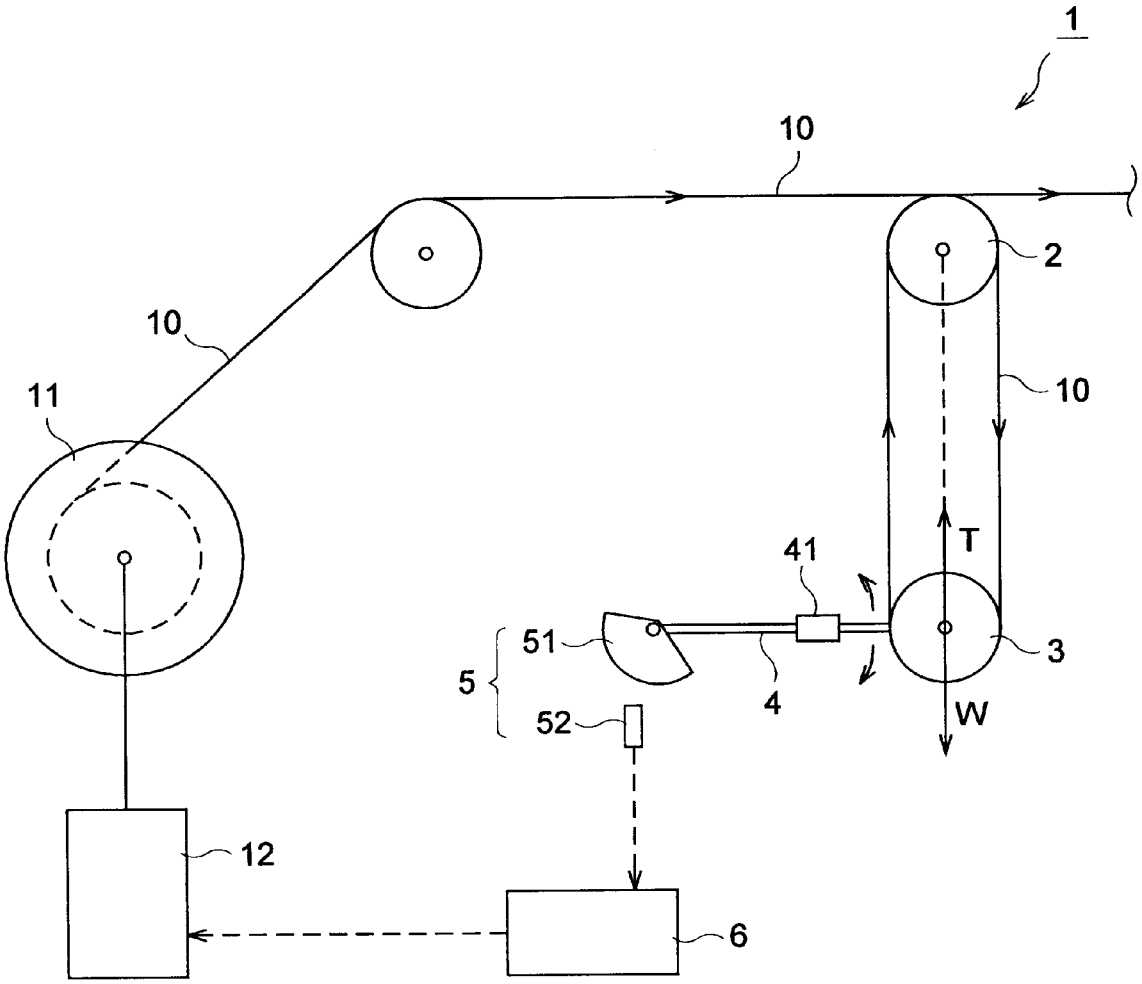
FIG. 1 is an explanatory view of a first embodiment of the tension control apparatus in accordance with the present invention.

In the following, some preferred embodiments of the present invention will be explained with reference to the accompanying drawings. Among the drawings, constituents identical to each other will be referred to with numerals or letters identical to each other, without their overlapping explanations being repeated. The ratios in size of the constituents in the drawings do not always match those in practice.

First Embodiment

FIG. 1 is an explanatory view of the tension control apparatus in accordance with the first embodiment. As shown in FIG. 1, this tension control apparatus 1 is capable of controlling an amount of tension to a linear body 10 by adjusting the position of the dancer rollers 3. While examples of the linear body 10 to which tension is applied include optical fiber and the like, this apparatus is also applicable to other members as long as they can be transferred by means of rollers. In the tension control apparatus 1, guide rollers 2 are disposed within the running path of the linear body 10, whereas dancer rollers 3 are placed below the guide rollers 2. The guide rollers 2 are axially supported so as to rotate as the linear body 10 runs, while their positions are made stationary so as not to fluctuate relative to the running linear body 10. The dancer rollers 3 are axially attached to the tip portion of an arm 4 so as to be rotatable, and its position would change as the arm 4 pivots up and down by using the supporting end as a pivot.

As shown in FIG. 1, the linear body 10 is wound about the guide rollers 2 and dancer rollers 3, thereby forming an elliptical running path of the linear body 10 which connects the outer peripheries of the guide rollers 2 and dancer rollers 3 together. During the running of the linear body 10, when a difference is generated between the linear speed of the linear body 10 before passing through the part constituted by the guide rollers 2 and dancer rollers 3 and that after passing therethrough, the arm 4 appropriately pivots up or down so as to adjust the length of this running path, thereby regulating the difference in linear speed. Thus, the tension control apparatus 1 stabilizes the running of the linear body 10.

The arm 4 is provided with a weight 41, whose weight applies a downward force to the free end of the arm 4. Consequently, as shown in FIG. 1, not only the dead weight of the dancer rollers 3 but also weights of the weight 41 and arm 4 and the like act on the dancer roller 3 to yield a vertically downward gravity W. During the running of the linear body 10, when the dancer rollers 3 are positioned directly below the guide rollers (the line connecting their center axes coincides with a vertical), while the dancer 3 maintains its position without displacement, the gravity W applied to the dancer rollers 3 and the tension T would be in balance with each other. This tension T is the sum of tensions applied to the linear body 10. The tension applied to the linear body 10 decreases substantially in proportion to the number of turns of the linear body 10 about the guide rollers and the dancer rollers 3.

As shown in FIG. 1, the tension control apparatus 1 is provided with an arm elevation/depression angle detector 5 and a motor controller 6. The arm elevation/depression angle detector 5 is constituted by an arc member 51 and a distance sensor 52. The arc member 51 is eccentrically attached to the proximal end (supporting point) portion of the arm 4 and is configured so as to rotate about the supporting point as the arm 4 pivots up and down. The distance sensor 52, which faces the outer peripheral surface of the arc member 51, is a sensor for outputting a signal corresponding to the distance to the outer peripheral surface of the arc member 51. Since the arc member 51 is eccentrically attached to the arm 4 as mentioned above, the distance between the supporting point and the outer periphery would change according to the rotation thereof, i.e., the elevation and depression of the arm 4. Since the distance between the distance sensor 52 and the outer peripheral surface of the arc member 51 thus changes, the angle of elevation or depression of the arm 4 can be detected according to the output signal of the distance sensor 52. Any sensor of photoelectric type, ultrasonic type, and any other types can be used as the distance sensor 52 as long as the distance to the outer peripheral surface of the arc member 51 can be detected thereby. Also, without being restricted to the combination of the arc member 51 and distance sensor 52, the arm elevation/depression angle detector 5 may have any other configuration as long as the angle of elevation or depression of the arm 4 can be detected thereby.

On the other hand, in FIG. 1, the motor controller 6 supplies a driving signal to a motor 12 for rotationally driving the bobbin 11 according to the output signal of the distance sensor 52, thereby controlling the rotation of the motor 12. For example, when the arm 4 is in a state above its preset angle, the motor controller 6 detects the state of the arm 4 according to the output signal of the distance sensor 52 and supplies a driving signal to the motor 12 so as to increase its rotational speed. Then, the rotational speed of the bobbin 11 increases. Consequently, the linear speed of the linear body 10 supplied to the guide roller 2 and dancer roller 3 (hereinafter referred to as "feeding speed") becomes higher than the linear speed of the linear body 10 pulled out from the guide roller 2 and dancer roller 3 (hereinafter referred to as "discharging speed"), whereby the length of the linear body 10 wound about the guide roller 2 and dancer roller 3 increases. As a result, the position of the dancer roller 3 is moved down, so that the arm 4 is directed downward. When the arm 4 is in a state below the preset angle, by contrast, the motor controller 6 detects the state of the arm 4 according to the output signal of the distance sensor 52 and supplies a driving signal to the motor 12 so as to decrease the rotational speed of the latter. Then, the rotational speed of the bobbin 11 decreases. Consequently, the discharging speed becomes higher than the feeding speed, thus reducing the length of the linear body 10 wound about the guide rollers 2 and dancer rollers 3, whereby the dancer rollers 3 are moved up so as to direct the arm 4 upward.

Thus, the arm elevation/depression angle detector 5 and the motor controller 6 function to appropriately adjust the linear speed of the linear body 10 so as to keep the control midpoint position of the dancer roller 3 (position where the dancer rollers 3 are to be maintained when the linear body 10 is running) and further, by changing the control midpoint position of the dancer rollers 3 itself, variably control the tension of the linear body 10 wound about the guide rollers 2 and dancer rollers 3. When the control midpoint position of the dancer rollers 3 is changed by the linear speed adjustment of the linear body 10, thereby changing the angle of elevation or depression of the arm 4; in response to the change in angle of elevation or depression of the arm 4, the direction of the line connecting the respective center axes of the guide rollers 2 and dancer rollers 3 changes, whereby the angle between this direction and a vertical (hereinafter simply referred to as "deflection angle") is altered. As this deflection angle is appropriately changed by the linear speed control of the linear body 10, the vector relationship between the gravity W and the resultant force of tension T applied to the linear body 10 changes. By utilizing this, the tension T can be adjusted to a predetermined amount.

Figure 2:
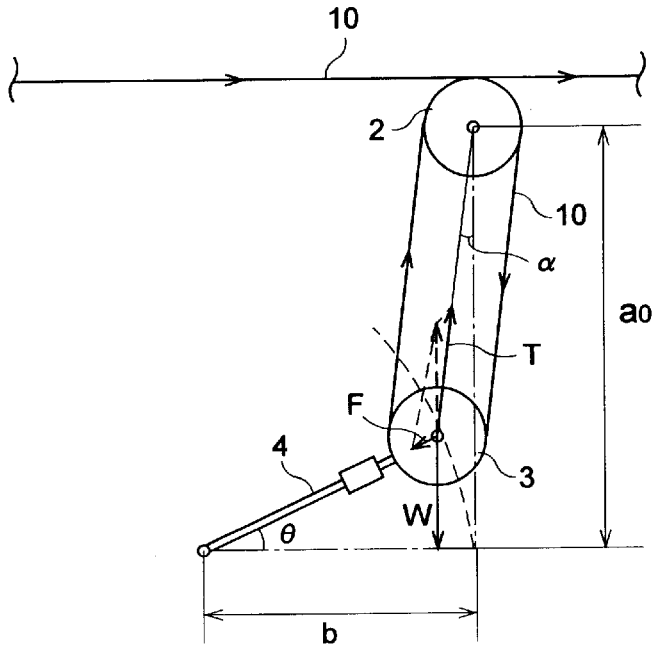
FIGS. 2 and 3 are views for explaining tension control in the first embodiment.
Figure 3:
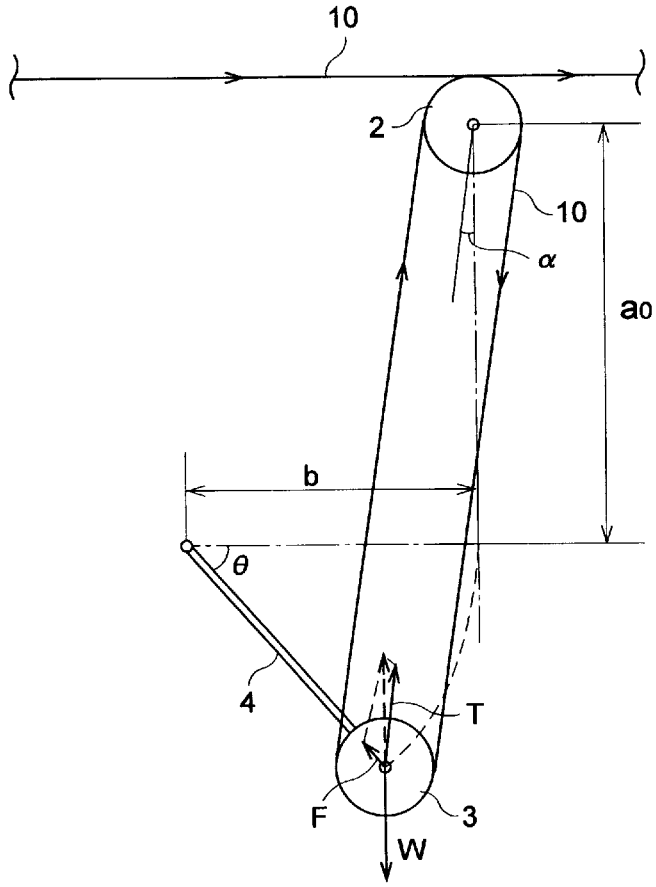

FIGS. 2 and 3 show the relationship between the deflection angle of the dancer rollers 3 and the tension of the linear body 10. In the following, the deflection angle of the dancer roller 3 is indicated by α. As shown in FIG. 2, in the case where the arm 4 is held in an upward state (in a state where the tip of the arm 4 is positioned higher than the proximal end thereof during the running of the linear body 10, the angle of elevation of the arm 4 being referred to as θ hereinafter), assuming the gravity applied to the dancer roller 3 composed of dead weights of the dancer roller 3 and weight 4 and the like to be W, the resultant force of tension applied to the linear body 10 to be T, and the supporting force of the arm 4 to be F, these three forces would be in balance with each other.

The balance of these three forces is represented by the following expression:

$$\frac{W}{\sin(90^\circ+\alpha+\theta)}=\frac{T}{\sin(90^\circ-\theta)}=\frac{F}{\sin(180^\circ-\alpha)} \tag{1}$$

From expression (1), $$T=W\frac{\sin(90^\circ-\theta)}{\sin(90^\circ+\alpha+\theta)} \tag{2}$$

holds true. Here, the dancer rollers 3 are positioned directly below the guide rollers 2 when the arm 4 is horizontal. Accordingly, assuming that the distance between the respective rotational centers of the guide rollers 2 and dancer rollers 3 is $a_0$, and that the distance between the proximal end of the arm 4 and the rotational center of the dancer rollers 3 is b, the following relationship:

$$\alpha=\tan^{-1}\left(\frac{b(1-\cos\theta)}{a_0-b\sin\theta}\right) \tag{3}$$

holds true.

Here, in the case where θ is positive while the rotational center of the dancer rollers 3 are positioned below the line connecting the rotational center of the guide rollers 2 and the proximal end of the arm 4, the supporting force F acts downward. The vertical component of the tension T, which must be in balance with the vertical component of the supporting force F and the gravity W, becomes greater by the amount corresponding to F. When the angle of elevation θ of the arm is made larger, the deflection angle α also increases according to expression (3), whereby the denominator of the right side of expression (2) becomes smaller than its numerator. Consequently, it can be seen that the larger the elevation angle θ is, the greater the tension T becomes.

By contrast, as shown in FIG. 3, when the arm 4 is held in a downward state (in a state where the tip of the arm 4 is positioned below the proximal end) during the running of the linear body 10, the supporting force F of the arm 4 becomes upward, whereby the resultant force of tension T would be smaller than the gravity W. Assuming that the angle of depression of the arm 4 is expressed by −θ, e.g., −30° refers to 30 degrees downward, the above-mentioned expressions (1) to (3) also hold true in this case as they are. Here, as the angle of depression is larger, i.e., the absolute value of θ is greater, the deflection angle α increases as can be seen from expression (3). Nonetheless, α<θ holds true as long as the guide roller 2 is located higher than the dancer roller 3. Accordingly, as the absolute value of θ is made larger, the denominator of the right side of expression (2) becomes greater than the numerator, whereby the tension T decreases.

Figure 4:
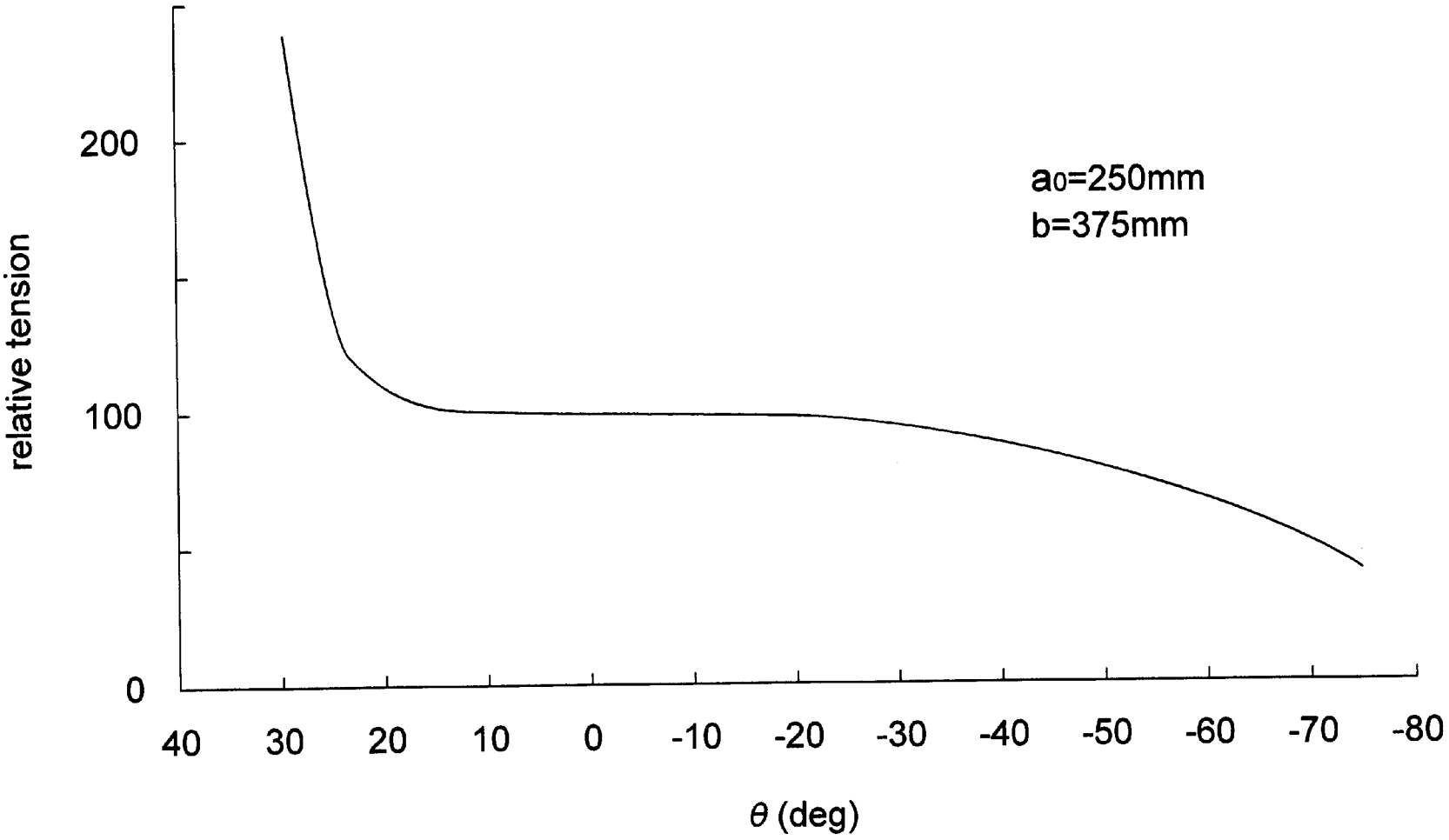
FIG. 4 is a graph showing a relationship between angle of elevation or depression θ of an arm and tension T applied to a linear body in the first embodiment.

FIG. 4 shows a specific correlation between the angle of elevation or depression θ of the arm 4 and the tension T applied to the linear body 10 in the case where the deflection angle α of the dancer roller 3 is generated. In FIG. 4, the ordinate indicates a relative value of tension applied to the linear body 10, taking the tension obtained when the arm 4 is horizontal as 100. The abscissa indicates the angle of elevation or depression θ of the arm 4 that fluctuates as the dancer rollers 3 moves up and down, associated with plus and minus signs respectively when the arm 4 is tilted upward and downward from the horizontal state. The relationship between the angle of elevation or depression θ and the relative tension in FIG. 4 is computed when the length of the arm 4 is about 375 mm, and the distance between the rotational centers of the guide rollers 2 and dancer rollers 3 with the arm 4 in a horizontal state is about 250 mm, while assuming that the gravity W applied to the dancer rollers 3 is constant. As can be seen from FIG. 4, the tension applied to the linear body 10 continuously changes as the angle of elevation or depression θ of the arm 4 changes relative to its horizontal state.

As mentioned above, the angle of elevation or depression θ can be changed according to the change in the distance between the guide rollers and dancer rollers with controlling a difference between the feeding and discharging speed.

Thus, when the linear speed of the linear body 10 is adjusted, the tension of the linear body 10 between the guide roller 2 and dancer roller 3 can be controlled.

Figure 5:
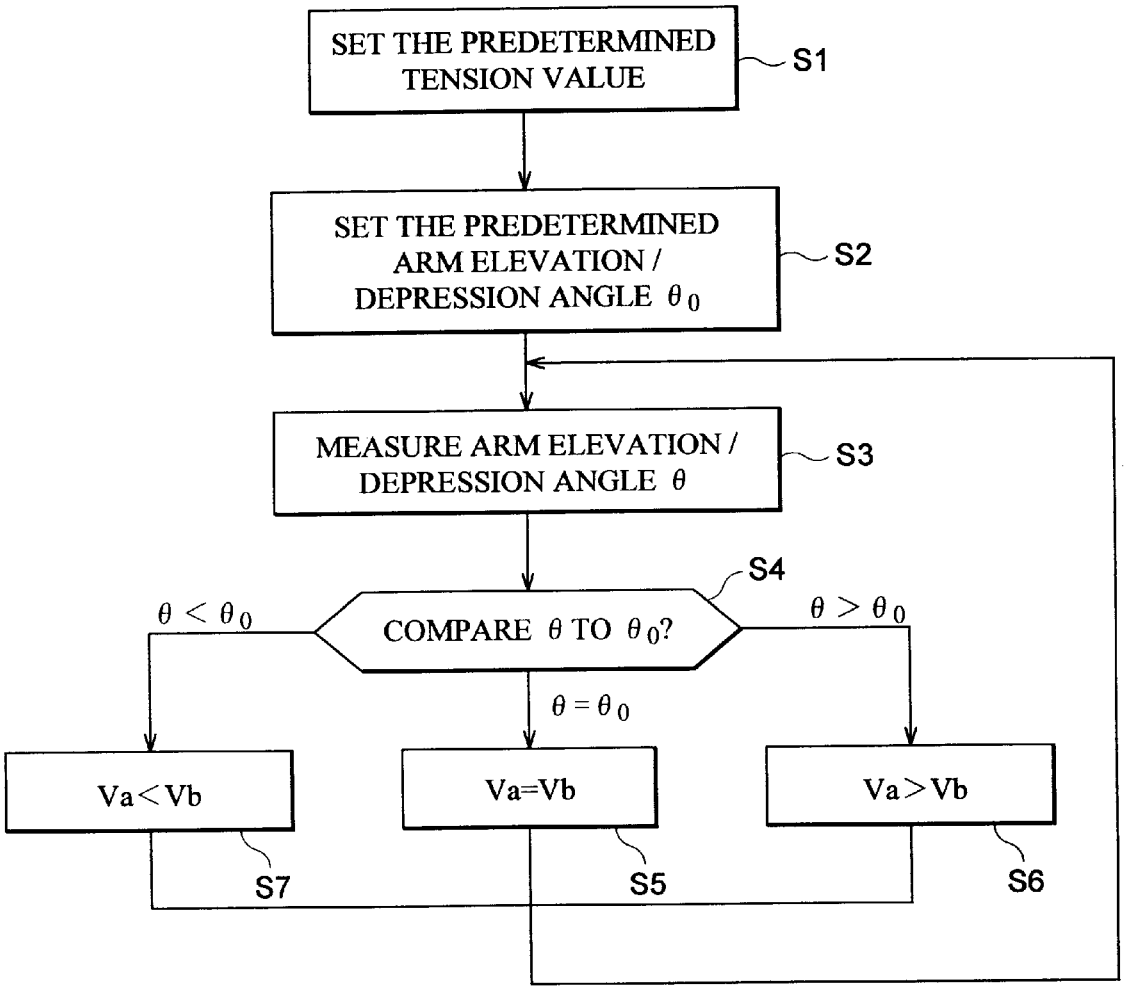
FIG. 5 is a flowchart of tension control in the first embodiment.

In the following, a method of using the tension control apparatus 1 and its operation will be explained. FIG. 5 is a flowchart of control upon operation.

The value of tension to be applied to the running linear body 10 is set (S1). This setting may be effected either by an operation for inputting a manually set value or by input of a set signal from an external device. The tension control apparatus 1 can adjust the tension during the running of the linear body 10 in such a manner that the arm 4 is set to a suitable angle $\theta_0$ of elevation or depression to make the deflection angle of the dancer rollers 3 at a predetermined angle (S2).

After the tension value of the linear body 10 is set, the motor 12 is driven to rotate, so that the bobbin 11 is rotated. Here, though not depicted, the linear body 10 is pulled at a predetermined speed downstream the tension control apparatus 1. Consequently, the linear body 10 is fed from the bobbin 11, runs about the outer peripheries of the guide rollers 2 and dancer rollers 3 once or a plurality of times, and finally travels to take-up reel. Here, the arm elevation/depression angle detector 5 detects the state of elevation or depression of the arm 4 (S3). In the case where the angle of elevation or depression θ of the arm 4 is at a predetermined value, the feeding speed and the discharging speed are held as they are (S5). In the case where the angle of elevation or depression θ of the arm 4 is found to be different from the set value, whereby the tension T applied to the linear body 10 does not coincide with the set tension; the angle of elevation or depression θ of the arm 4 is adjusted, so as to appropriately regulate the tension T of the linear body 10. For example, in FIG. 2, when the arm 4 is pivoted upward too much, the deflection angle α of the dancer rollers 3 is so large that the tension T applied to the linear body 10 is greater than the set tension. Here, the motor controller 6 detects the tension state of the linear body 10 by way of the arm elevation/depression angle detector 5, and outputs a driving signal to the motor 12 so as to increase the rotational speed thereof. Then, the rotational speed of the motor 12 increases, whereby the linear speed of the linear body 10 from the bobbin 11 to the dancer rollers 3 is enhanced. Consequently, the position of the dancer roller 3 descends, whereby the deflection angle α of the dancer roller 3 and the angle of elevation or depression θ of the arm 4 are reduced. As the deflection angle α and the angle of elevation or depression θ decrease, the tension T applied to the linear body 10 is reduced so as to be adjusted to the set tension (S6).

By contrast, in FIG. 3, when the arm 4 is pivoted downward too much, the deflection angle α of the dancer rollers 3 is so large that the tension T applied to the linear body 10 is smaller than the set tension. Here, the motor controller 6 detects the tension state of the linear body 10 by way of the arm elevation/depression angle detector 5, and outputs a driving signal to the motor 12 so as to lower the rotational speed thereof. Then, the rotational speed of the motor 12 decreases, whereby the linear speed of the linear body 10 from the bobbin 11 to the dancer rollers 3 is reduced. Consequently, the position of the dancer rollers 3 ascends, whereby the deflection angle α of the dancer rollers 3 and the absolute value of angle of elevation or depression θ of the arm 4 are reduced. As the deflection angle α and the absolute value of angle of elevation or depression θ decrease, the tension T applied to the linear body 10 is enhanced so as to be adjusted to the set tension (S7).

Thus, as the linear speed of the linear body 10 is controlled, the angle of elevation or depression θ of the arm 4 can be adjusted while the deflection angle α of the dancer roller 3 is generated, whereby the tension T applied to the linear body 10 can be regulated arbitrarily.

As explained in the foregoing, by simply moving the dancer roller 3, the tension control apparatus 1 in accordance with this embodiment can easily control the tension applied to the linear body 10 by increasing or decreasing it, without employing a complicated mechanism or the like. Since the tension control of the linear body 10 can be effected by adjusting the linear speed of the linear body 10 fed in or discharged from the tension control apparatus 1, it can be easily performed even during the running of the linear body 10. Further, when the direction of supporting force of the arm 4 is changed, the gravity applied to the dancer rollers 3 and the tension matching the gravity can be adjusted so that the force not smaller than the gravity applied to the dancer roller 3 is applied to the linear body 10 as tension. Accordingly, the tension T applied to the linear body 10 can be changed greatly.

Second Embodiment

In the following, the tension control apparatus in accordance with the second embodiment of the present invention will be explained.

In the first embodiment, the dancer rollers 3 are positioned directly below the guide rollers 2 when the arm 4 is in a horizontal state, and the arm 4 is pivoted up and down so as to generate the deflection angle α, thereby controlling the tension of the linear body 10. The present invention should not be restricted thereto, however. Namely, the tension control apparatus 1*a* in accordance with the second embodiment generates and changes the deflection angle α of the dancer rollers 3 by horizontally moving the dancer roller 3 relative to the guide rollers 2, thereby effecting tension control of the linear body 10.

Figure 6:
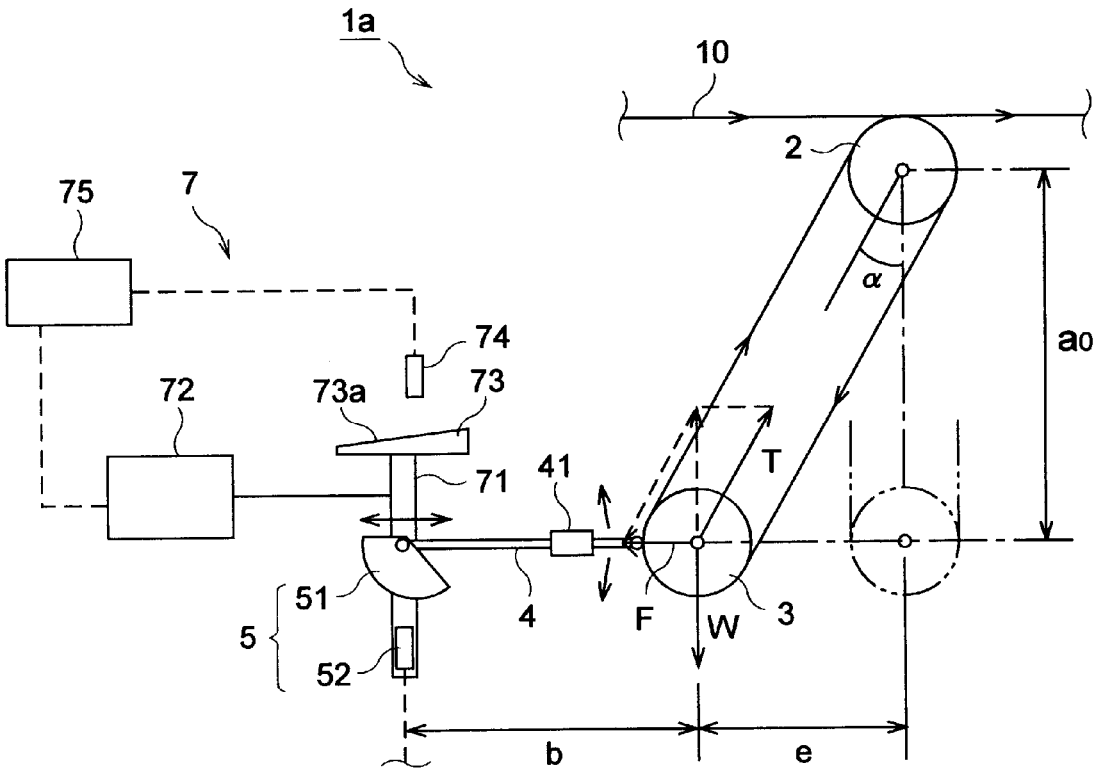
FIG. 6 is an explanatory view of a second embodiment (and a third embodiment) of the tension control apparatus in accordance with the present invention.

FIG. 6 is an explanatory view of the tension control apparatus 1*a* in accordance with the second embodiment. In the tension control apparatus 1*a* shown in FIG. 6, the proximal end portion of the arm 4 is attached to a slide mechanism 7, by which the arm 4 and the dancer roller 3 are horizontally movable in an arbitrary manner. For example, the slide mechanism 7 is constituted by a movable member 71, a slide driving section 72, a tilted member 73, a sensor 74, and a horizontal displacement controller 75. The proximal end portion of the arm 4 is attached to the movable member 71, which moves in order to adjust the tension of the linear body 10. Consequently, as the movable member 71 moves, the arm 4 and the dancer rollers 3 would move. Preferably, as shown in FIG. 6, a distance sensor 52 for detecting the elevation/depression state of the arm 4 is attached to the movable member 71. As the slide driving section 72, which is used for moving the movable member 71, a moving mechanism constituted by a motor, a feed screw, a slide guide, and the like may be used, for example.

The tilted member 73 and the sensor 74 are used for detecting the amount of horizontal displacement of the arm 4 and dancer rollers 3. The tilted member 73 has a tilted surface 73*a* inclined with respect to the moving direction of the movable member 71 and is attached to the movable member 71 so as to be moved together therewith. The sensor 74 is fixed outside the movable member 71 so as to face the tilted surface 73*a* of the tilted member 73 and output a signal corresponding to the distance to the tilted surface 73*a*. According to the output signal of the sensor 74, the distance of horizontal displacement of the arm 4 and dancer roller 3 is detected. Any sensor of photoelectric type, ultrasonic type, and any other types can be used as the sensor 74 as long as the distance to the tilted surface 73*a* can be detected thereby. Also, as the means for detecting the amount of displacement of the arm 4 and dancer rollers 3, without being restricted to the tilted member 73 and the sensor 74, any other elements may be used as long as the amount of displacement can be detected thereby.

In FIG. 6, the horizontal displacement controller 75 is used for outputting a driving signal to the slide driving section 72 and receiving the output signal of the sensor 74 so as to control the displacement of the dancer rollers 3. As the amount of displacement e of the dancer rollers 3 is set, the driving signal corresponding thereto is outputted from the horizontal displacement controller 75, whereby the slide driving section 72 moves the dancer rollers 3 by way of the movable member 71.

Also, in the tension control apparatus 1*a*, the guide rollers 2, motor controller 6, and motor 12 similar to those of the first embodiment are employed.

In the following, with reference to FIG. 6, the relationship between the deflection angle of the dancer rollers 3 and the tension of the linear body 10 in the tension control apparatus 1*a* will be explained. In FIG. 6, by horizontally moving the dancer rollers 3 so as to change the deflection angle α of the dancer rollers 3, the tension control apparatus la can arbitrarily control the tension applied to the linear body 10. For example, in the state depicted in FIG. 6, when the dancer rollers 3 are moved by the slide mechanism 7 so as to reduce its amount of horizontal displacement e (distance to the vertical from the guide roller 2), the deflection angle a of the dancer roller 3 decreases, whereby the direction of the resultant force of tension T applied to the dancer roller 3 approaches the vertical direction. Consequently, the tension T becomes smaller by the amount corresponding to the reduced horizontal component of the tension T (component matching the supporting force F of the arm 4). Here, the linear speed of the linear body 10 is appropriately adjusted by the arm elevation/depression angle detector 5 and the motor controller 6 (not depicted in FIG. 6) such that the arm keeps a horizontal state.

By contrast, in the state of FIG. 6, when the slide mechanism 7 moves the dancer roller 3 so as to increase the amount of horizontal displacement e, the deflection angle α of the dancer roller 3 is enhanced, whereby the resultant force of tension T applied to the dancer roller 3 greatly tilts from the vertical direction. Consequently, the horizontal component in the resultant force of tension T increases, thereby enhancing the resultant force of tension T.

In view of the balance between the three forces T, F, and W, the above-mentioned relationship between the deflection angle α and the resultant force of tension T can be represented by the following expression:

$$T = \frac{W}{\sin(90° + \alpha)} = \frac{W}{\cos\alpha} \tag{4}$$

Here, α in expression (4) can be determined by the following expression:

$$\alpha = \tan^{-1}\frac{e}{a_0} \tag{5}$$

Figure 7:
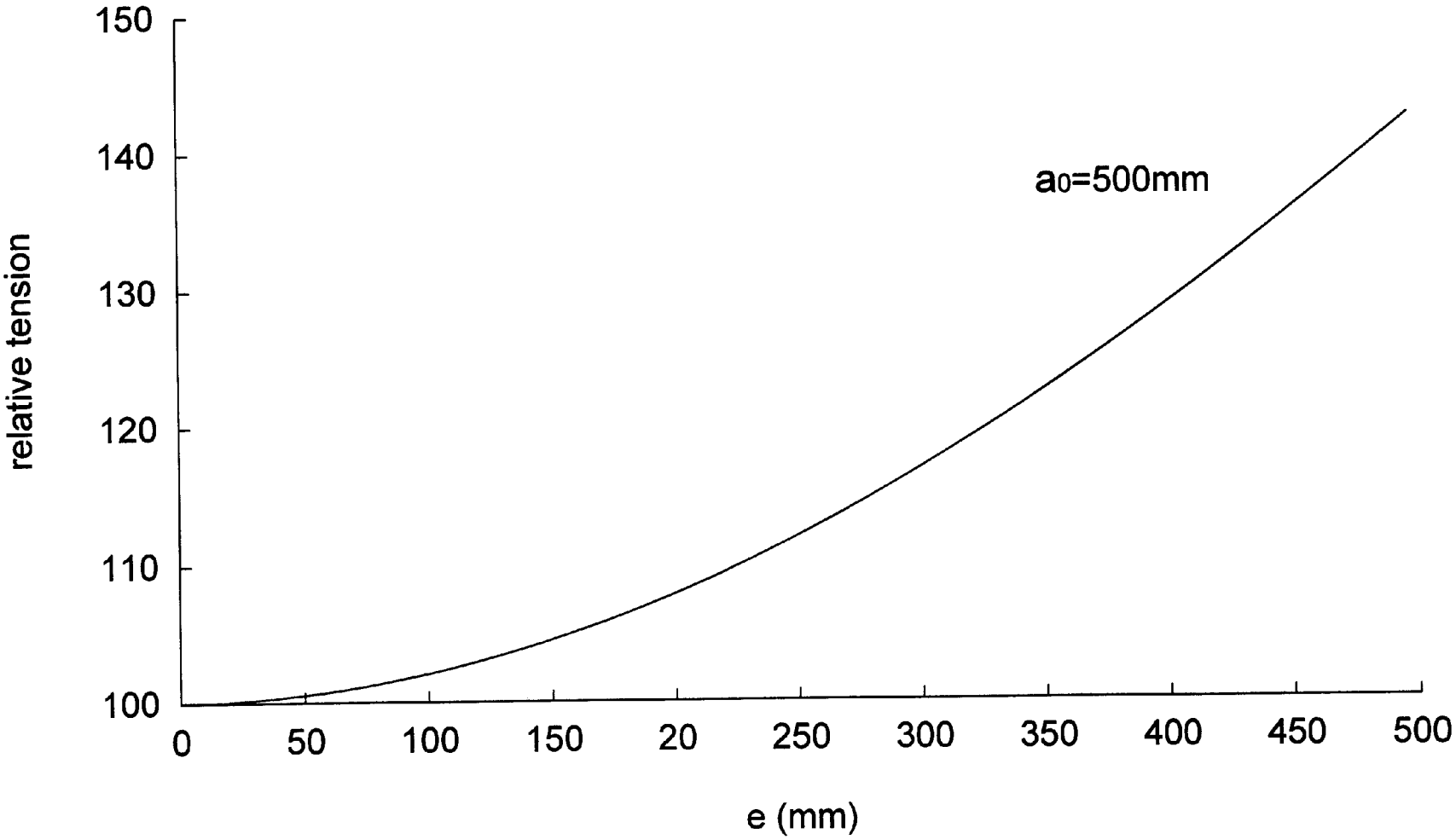
FIG. 7 is a graph showing a relationship between amount of horizontal displacement e of a dancer roller and tension T applied to a linear body in the second embodiment.

FIG. 7 shows a specific correlation between the amount of horizontal displacement e and the tension T applied to the linear body 10. In FIG. 7, the ordinate indicates a relative value of tension applied to the linear body 10, taking the tension obtained when the dancer roller 3 is positioned directly below the guide roller 2 while the arm 4 is horizontal as 100. The abscissa indicates the amount of horizontal displacement e of the dancer roller 3 from the position directly below the guide roller 2. The relationship between the amount of displacement e and the tension value in FIG. 7 is obtained when the length of the arm 4 is about 375 mm, and the distance between the guide roller 2 and the dancer roller 3 with the arm 4 in a horizontal state is about 500 mm. As can be seen from FIG. 7, the farther the dancer roller 3 is distanced from the vertical of the guide roller 2, the greater becomes the tension value applied to the linear body 10. This is because, the farther the dancer rollers 3 are distanced from the vertical of the guide rollers 2, the greater becomes the deflection angle α of the dancer rollers 3.

Thus, by horizontally moving the dancer rollers 3 so as to change the deflection angle α thereof, the tension control apparatus 1*a* can arbitrarily control the tension applied to the linear body 10.

In the following, a method of using the tension control apparatus 1*a* and its operation will be explained.

In FIG. 6, an instruction is supplied to the horizontal displacement controller 75, so as to move the dancer rollers 3, thereby setting the value of tension to be applied to the running linear body 10. This setting may be effected either by an operation for inputting a manually set value or by input of a set signal from an external device. The adjustment of tension in the tension control apparatus la is effected such that, during the running of the linear body 10, the amount of horizontal displacement e of the dancer rollers 3 is maintained so as to keep the deflection angle α of the dancer rollers 3 at a predetermined angle.

After the tension value of the linear body 10 is set, the motor 12 is driven to rotate, so that the bobbin 11 is rotated. Here, though not depicted, the linear body 10 is pulled at a predetermined speed downstream the tension control apparatus 1*a*. Consequently, the linear body 10 is fed from the bobbin 11, runs about the outer peripheries of the guide rollers 2 and dancer rollers 3 once or a plurality of times, and finally travels to a take-up reel (not shown). Here, when the tension T to be applied to the linear body 10 is to be changed, the dancer rollers 3 are horizontally moved by the slide mechanism 7. For example, in FIG. 6, when the dancer rollers 3 are moved toward the guide roller 2 (rightward in FIG. 6) by the slide mechanism 7, the deflection angle a of the dancer rollers 3 decreases, thus reducing the horizontal component of the tension T applied to the linear body 10, whereby the tension T can be reduced by the amount corresponding thereto. By contrast, in FIG. 6, when the dancer rollers 3 are moved away from the guide roller 2 (leftward in FIG. 6) by the slide mechanism 7, the deflection angle a of the dancer rollers 3 increases, thus enhancing the horizontal component of the tension T applied to the linear body 10, whereby the tension T can be enhanced by the amount corresponding thereto.

Thus, when the dancer rollers 3 are appropriately moved horizontally so as to control the deflection angle α thereof, the tension T applied to the linear body 10 can be adjusted arbitrarily.

As explained in the foregoing, by simply moving the dancer rollers 3, the tension control apparatus 1*a* in accordance with this embodiment can easily control the tension applied to the linear body 10 by increasing or decreasing it, without employing a complicated mechanism or the like. Since the tension control of the linear body 10 can be effected by horizontally moving the dancer rollers 3, it can be easily performed even during the running of the linear body 10. Further, since the gravity applied to the dancer rollers 3 and the vertical component of the tension of the linear body 10 are in balance with each other, a force not smaller than the gravity applied to the dancer rollers 3 can be applied to the linear body 10 as tension. Accordingly, the tension T applied to the linear body 10 can be changed greatly.

Third Embodiment

In the following, the tension control apparatus in accordance with the third embodiment will be explained.

In the tension control apparatus 1*a* in accordance with the second embodiment, during the running of the linear body 10, while the arm 4 is kept horizontal, the dancer rollers 3 are horizontally moved together with the arm 4, so as to change the deflection angle α of the dancer rollers 3, thereby controlling the tension of the linear body 10. However, while the dancer rollers 3 are horizontally moved, the angle of elevation or depression of the arm 4 may be adjusted so as to control the tension of the linear body 10.

Namely, the tension control apparatus 1*a* in accordance with the third embodiment horizontally moves the arm 4 together with its proximal end such that the dancer rollers 3 are located at a position deviated from the position directly below the guide roller 2 when the arm 4 is horizontal, and pivots the arm 4 up and down in this state, thereby controlling the tension of the linear body 10. As the tension control apparatus 1*a,* the one similar to the tension control apparatus 1 in accordance with the second embodiment can be used. Such tension control apparatus 1*a* can also control the tension of the linear body 10 in response to the angle of elevation or depression of the arm 4, whereby the effects similar to those of the tension control apparatus 1 and 1*a* in accordance with the first and second embodiments can be obtained.

The resultant force of tension T can be represented by the above-mentioned expression (2) of the first embodiment.

Here, the deflection angle α is determined by the following expression:

$$\alpha = \tan^{-1}\left(\frac{b + e - b\cos\theta}{a_0 - b\sin\theta}\right) \quad (6)$$

Figure 8:
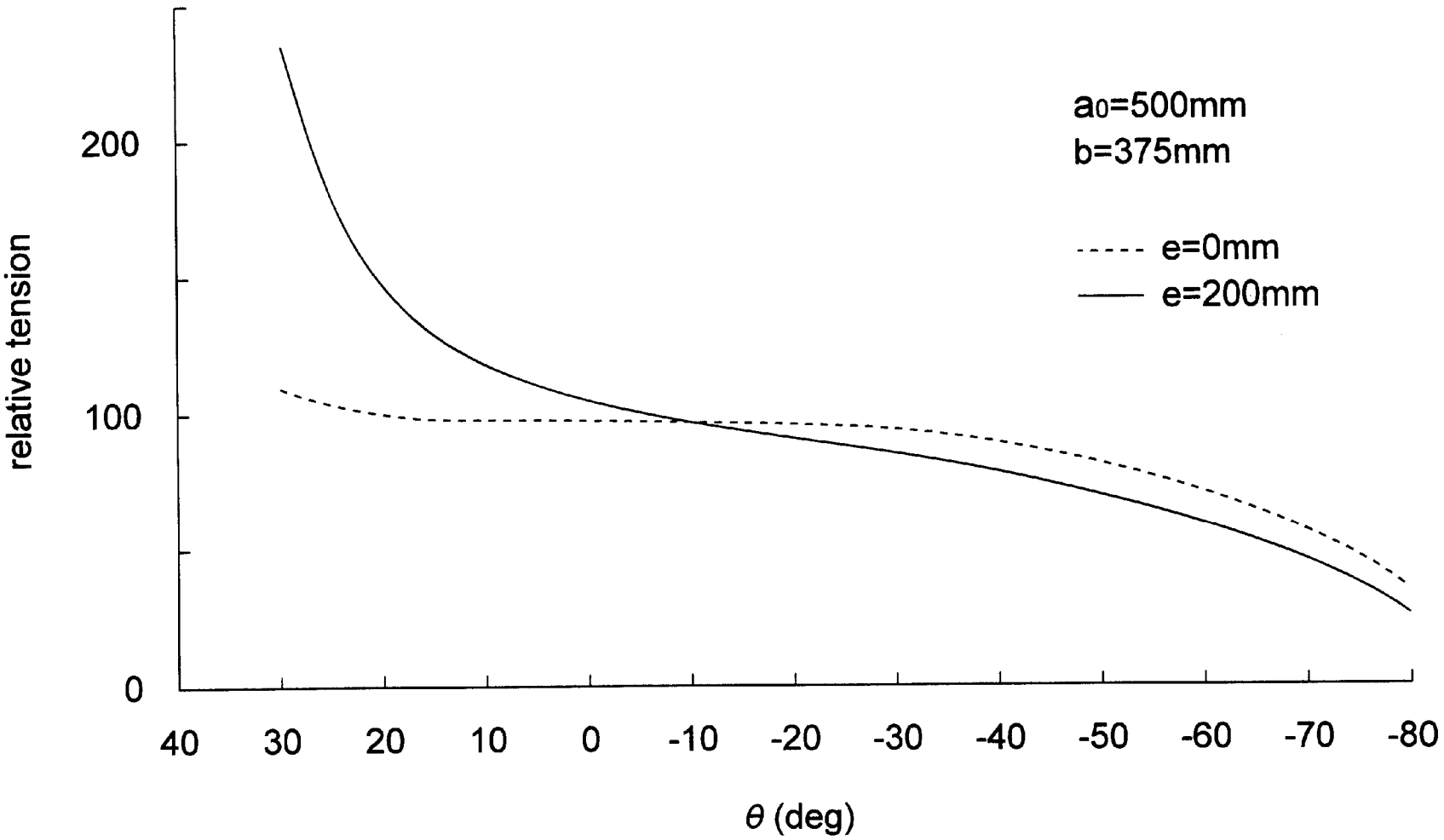
FIG. 8 is a graph showing a relationship between angle of elevation or depression θ of an arm, amount of horizontal displacement e of a dancer roller, and tension T applied to a linear body in the third embodiment.

FIG. 8 shows a relationship between the angle of elevation or depression θ of the arm 4 and the resultant force of tension T applied to the linear body 10 in the tension control apparatus 1*a* in accordance with the third embodiment. In FIG. 8, the ordinate indicates a relative value of resultant force of tension applied to the linear body 10, taking the tension obtained when the dancer rollers 3 are positioned directly below the guide roller 2 while the arm 4 is horizontal as 100. The abscissa indicates the angle of elevation or depression θ of the arm 4 that fluctuates as the dancer rollers 3 move up and down, associated with plus and minus signs respectively when the arm 4 is tilted upward and downward from the horizontal state. The relationship between the angle of elevation or depression θ and the tension value in FIG. 8 is obtained when the length (b) of the arm 4 is about 375 mm, and the distance ($a_0$) between the rotational centers of the guide rollers 2 and dancer rollers 3 with the arm 4 in a horizontal state is about 500 mm. Here, the change in tension T relative to the angle of elevation or depression θ in a state where the dancer rollers 3 are horizontally moved from the position directly below the guide rollers 2 by about 200 mm (e=200 mm) is indicated by solid line, whereas the change in tension T relative to the angle of elevation or depression θ in a state where the dancer rollers 3 are positioned directly below the guide rollers 2 is indicated by dotted line.

As can be seen from FIG. 8, the tension value of the linear body 10 changes as the angle of elevation or depression θ of the arm 4 changes relative to its horizontal state so as to follow the vertical displacement of the dancer rollers 3. Also, as compared with the case indicated by the dotted line where the dancer rollers 3 are positioned directly below the guide rollers 2 (corresponding to the first embodiment), the tension of the linear body 10 in the tension control apparatus 1*b* in accordance with the third embodiment indicated by the solid line yields a greater amount of change in response to the change in angle of elevation or depression θ of the arm 4, while forming a wider area where the tension T linearly changes relative to the angle of elevation or depression θ as compared with the first embodiment. Accordingly, it becomes easier to minutely adjust the tension of the linear body 10, whereby its control is facilitated.

Fourth Embodiment

In the following, the tension control apparatus in accordance with the fourth embodiment will be explained.

In the tension control apparatus la in accordance with the second embodiment, the dancer rollers 3 are horizontally moved so as to change the deflection angle α of the dancer roller 3, thereby controlling the tension of the linear body 10. However, the dancer rollers 3 may be moved vertically so as to change the deflection angle α, thereby controlling the tension of the linear body 10.

Figure 9:
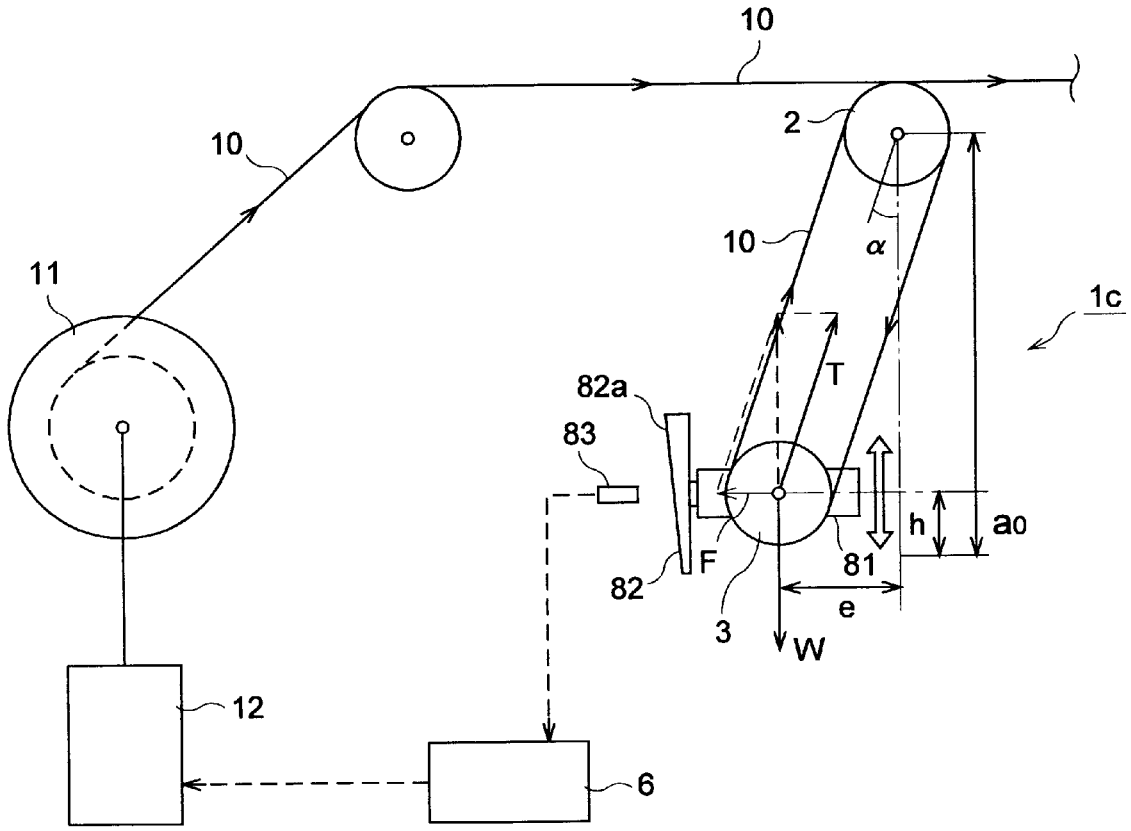
FIG. 9 is an explanatory view of a fourth embodiment of the tension control apparatus in accordance with the present invention.

FIG. 9 is an explanatory view of the tension control apparatus 1*c* in accordance with the fourth embodiment. In the tension control apparatus 1*c* shown in FIG. 9, the dancer rollers 3 are disposed below the guide rollers 2, while being vertically slidable. Here, the dancer rollers 3 are made slidable at positions not directly below the guide rollers 2, whereby the deflection angle α of the dancer rollers 3 changes as it vertically slides. For example, as shown in FIG. 9, the sliding mechanism for the dancer rollers 3 is constituted when the dancer rollers 3 are attached to a movable member 81 which is vertically slidable. In order to form the sliding mechanism for the movable member 81, the movable member 81 may latch a vertically-extending guide rail or the like.

A tilted member 82 is attached to the movable member 81, whereas a sensor 83 is disposed near the tilted member 82. The tilted member 82 and the sensor 83 are used for detecting the amount of vertical displacement of the dancer roller 3. The tilted member 82 has a tilted surface 82*a* inclined with respect to the moving direction of the movable member 81 and is attached to the movable member 81 so as to be moved together therewith. The sensor 83 is fixed outside the movable member 81 so as to face the tilted surface 82*a* of the tilted member 82 and output a signal corresponding to the distance to the tilted surface 82*a*. According to the output signal of the sensor 83, the distance of vertical displacement of the dancer rollers 3 is detected. Any sensor of photoelectric type, ultrasonic type, and any other types can be used as the distance sensor 83 as long as the distance to the tilted surface 82*a* can be detected thereby. Also, as the means for detecting the amount of displacement of the dancer rollers 3, without being restricted to the tilted member 82 and the sensor 83, any other elements may be used as long as the amount of displacement can be detected thereby. Here, the guide rollers 2, motor controller 6, and motor 12 similar to those in the first embodiment and the like are employed in the tension control apparatus 1*c*.

In the following, with reference to FIG. 9, a relationship between the deflection angle of the dancer roller 3 and the tension of the linear body 10 in the tension control apparatus 1*c* will be explained. In FIG. 9, by vertically moving the dancer rollers 3 so as to change the deflection angle α thereof, the tension control apparatus 1*c* can arbitrarily control the tension T applied to the linear body 10. For example, in the state of FIG. 9, when the linear speed of the linear body 10 is adjusted so as to move the dancer rollers 3 downward, the deflection angle α of the dancer rollers 3 is reduced, whereby the direction of the tension T applied to the dancer rollers 3 approaches the vertical direction. Consequently, the horizontal component in the tension T decreases, whereby the tension T is reduced by the amount corresponding thereto.

By contrast, in the state of FIG. 9, when the linear speed of the linear body 10 is adjusted so as to move the dancer rollers 3 upward, the deflection angle α of the dancer roller 3 is enhanced, whereby the tension T applied to the dancer rollers 3 is greatly tilted. Consequently, the horizontal component in the tension T increases, thereby enhancing the tension T.

This relationship is represented by the above-mentioned expression (4). Here, α is determined by the following expression:

$$\alpha = \tan^{-1}\left(\frac{e}{a_0 - h}\right) \quad (7)$$

wherein $a_0$ is the distance between the respective rotational centers of the guide rollers 2 and dancer rollers 3 at a reference point, and h is the amount of displacement of the dancer rollers 3 from the reference point with its upward direction indicated as positive.

Figure 10:
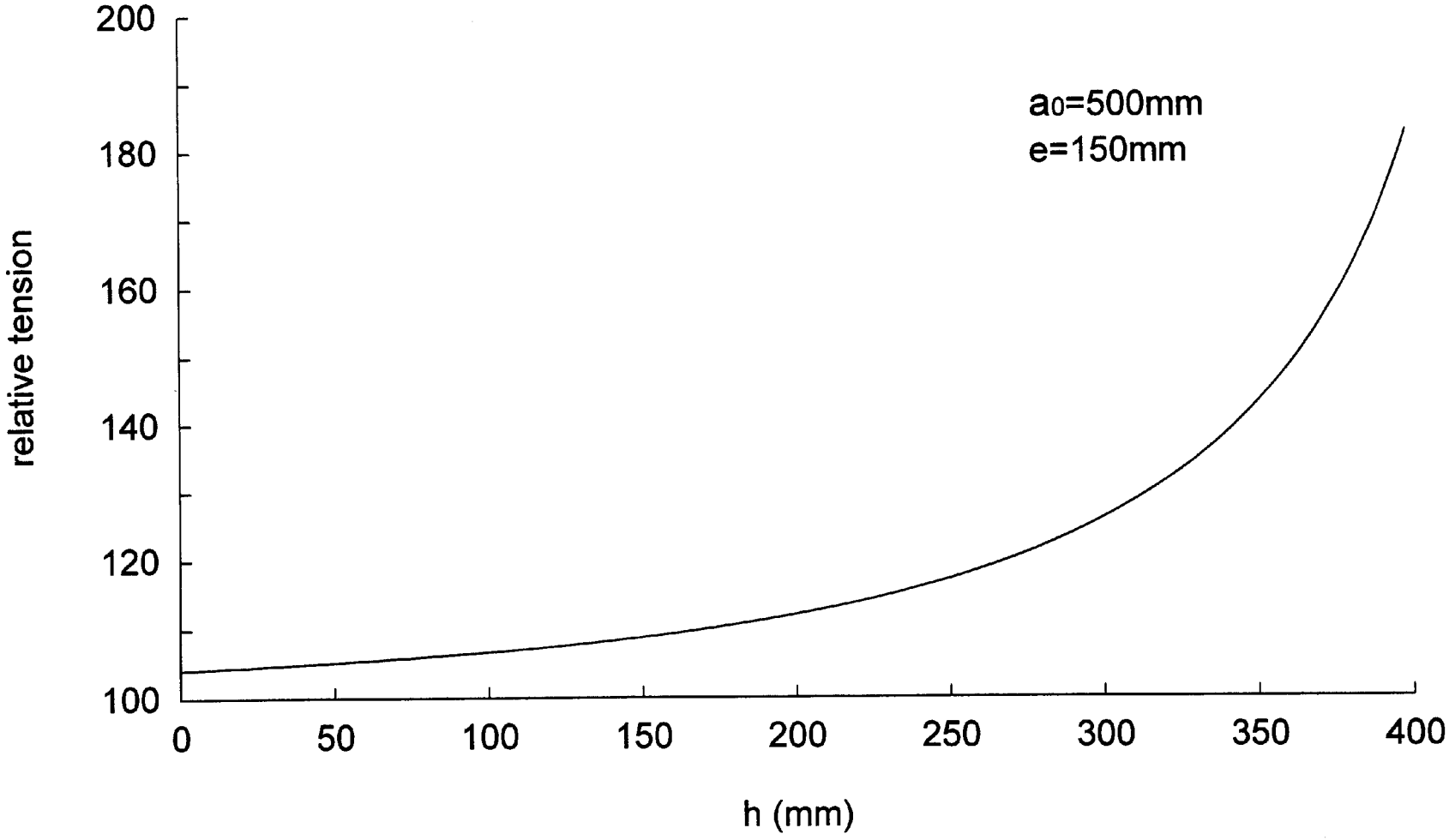
FIG. 10 is a graph showing a relationship between amount of vertical displacement h of a dancer roller and tension T applied to a linear body in the fourth embodiment.

FIG. 10 shows a specific correlation between the amount of vertical displacement h of the dancer rollers 3 and the tension T applied to the linear body 10. The abscissa indicates the amount of vertical displacement h of the dancer rollers 3, representing the amount of upward displacement from a reference position which is separated from the guide rollers 2 by about 500 mm. Here, the axis of displacement of the dancer rollers 3 are separated by 150 mm (e=150 mm) from the vertical intersecting with the rotational centers of the guide rollers 2. In FIG. 10, the ordinate indicates a relative value of tension T applied to the linear body 10, taking the tension obtained when e equals 0 mm and h equals 0 mm as 100.

As can be seen from FIG. 10, the farther the dancer roller 3 moves up, the greater the tension value of the linear body 10 becomes. It is due to the fact that the deflection angle $\alpha$ of the dancer roller 3 becomes greater as the dancer rollers 3 move up.

Thus, by vertically moving the dancer roller 3 so as to change the deflection angle a thereof, the tension control apparatus 1*c* of this embodiment can arbitrarily control the tension T applied to the linear body 10.

In the following, a method of using the tension control apparatus 1*c* and its operation will be explained.

First, in FIG. 9, the value of tension to be applied to the running linear body 10 is set. This setting may be effected either by an operation for inputting a manually set value or by input of a set signal from an external device. The adjustment of tension in the tension control apparatus 1*c* is effected such that, during the running of the linear body 10, the dancer rollers 3 are set to a predetermined vertical positions so as to keep the deflection angle of the dancer rollers 3 at a predetermined angle.

After the tension value of the linear body 10 is set, the motor 12 is driven to rotate, so that the bobbin 11 is rotated. Here, though not depicted, the linear body 10 is pulled at a predetermined speed downstream the tension control apparatus 1*c*. Consequently, the linear body 10 is fed from the bobbin 11, runs about the outer peripheries of the guide rollers 2 and dancer rollers 3 once or a plurality of times, and finally travels to take-up reel (not shown). Here, when the tension T to be applied to the linear body 10 is to be changed, the linear speed of the linear body 10 is adjusted so as to alter the vertical positions of the dancer rollers 3. For example, in FIG. 9, when the linear speed of the linear body 10 is adjusted so as to move the dancer rollers 3 downward, the deflection angle $\alpha$ of the dancer rollers 3 decreases, thus reducing the horizontal component of the tension T applied to the linear body 10. Consequently, the tension T is reduced by the amount corresponding to thus reduced horizontal component. By contrast, in FIG. 9, when the linear speed of the linear body 10 is adjusted so as to move the dancer rollers 3 upward, the deflection angle $\alpha$ of the dancer rollers 3 increases, thus enhancing the horizontal component of the tension T applied to the linear body 10, whereby the tension T increases by the amount corresponding thereto.

Thus, when the vertical positions of the dancer rollers 3 are appropriately changed so as to control the deflection angle $\alpha$ thereof, the tension T applied to the linear body 10 can be adjusted arbitrarily.

As explained in the foregoing, by simply moving the dancer rollers 3, the tension control apparatus 1*c* in accordance with this embodiment can easily control the tension applied to the linear body 10 by increasing or decreasing it, without employing a complicated mechanism or the like. Since the tension control of the linear body 10 can be effected by vertically moving the dancer rollers 3, it can be easily performed even during the running of the linear body 10. Further, since the gravity applied to the dancer rollers 3 and the vertical component of the resultant force of tension of the linear body 10 are in balance with each other, a force not smaller than the gravity applied to the dancer rollers 3 can be applied to the linear body 10 as tension. Accordingly, the tension T applied to the linear body 10 can be changed greatly.

Fifth Embodiment

In the following, the tension control apparatus in accordance with the fifth embodiment will be explained.

While the tension control apparatus 1 and 1*a* to 1*c* in accordance with the first to fourth embodiments control the tension of the linear body 10 by moving or changing the positional state of the dancer rollers 3, they may comprise means for actually measuring the tension of the linear body 10. Namely, the tension control apparatus 1*d* in accordance with the fifth embodiment comprises tension detecting means for actually measuring the tension of the linear body 10.

Figure 11:
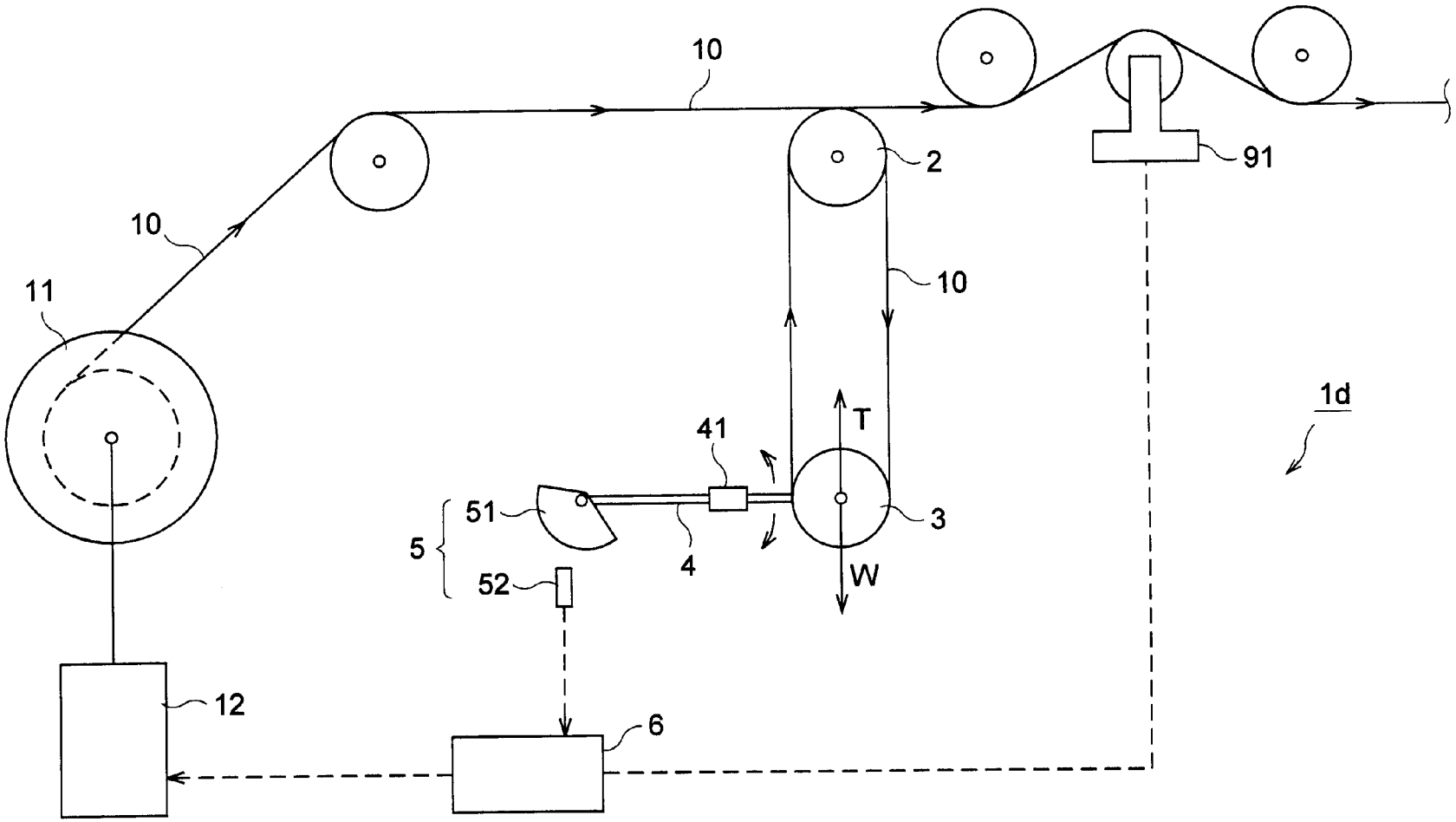
FIG. 11 is an explanatory view of a fifth embodiment of the tension control apparatus in accordance with the present invention.
Figure 12:
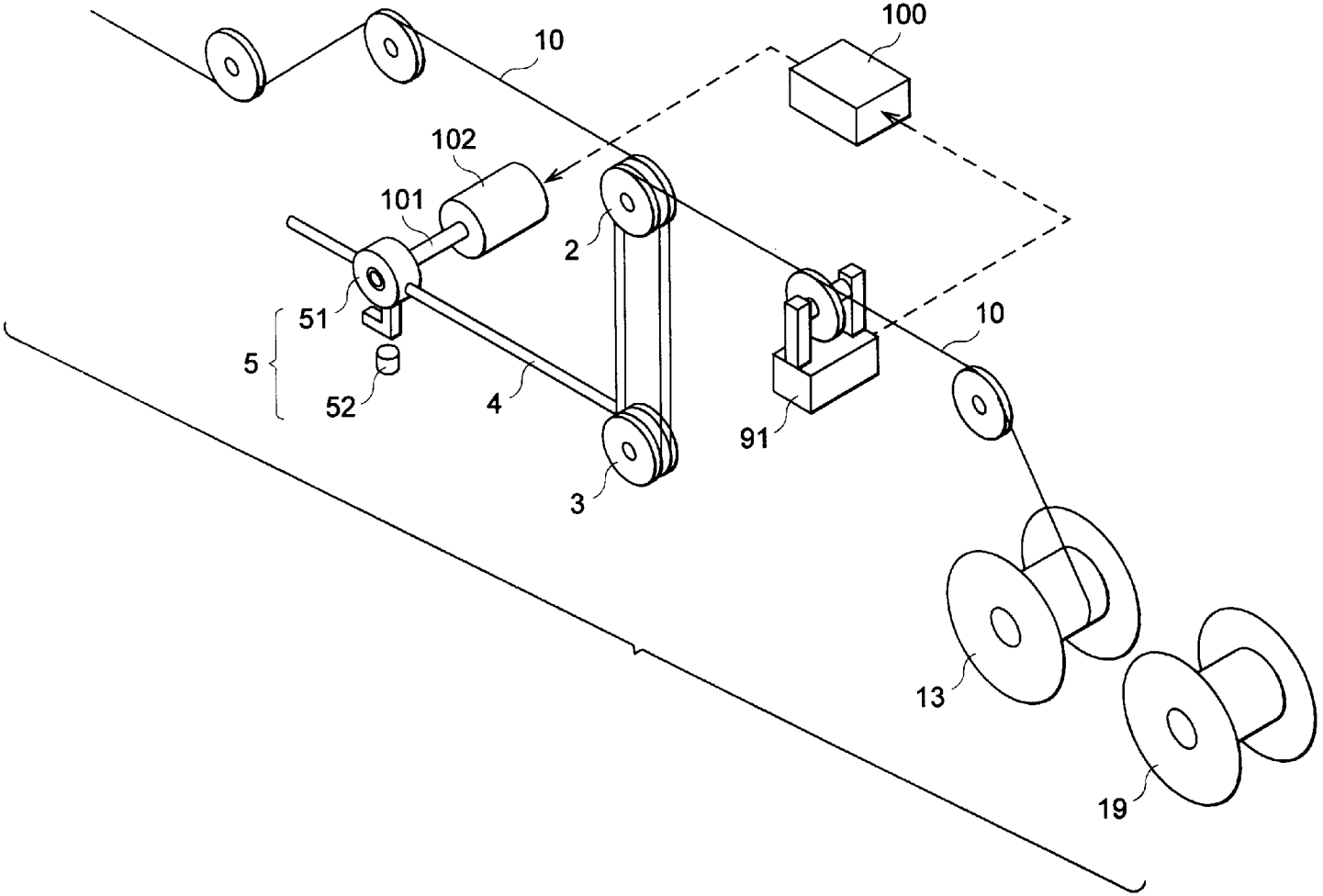
Fig.12 ( PRIOR ART )
FIG. 12 is an explanatory view of the conventional tension control apparatus.

FIG. 11 is an explanatory view of the tension control apparatus 1*d* in accordance with this embodiment. The tension control apparatus shown in FIG. 11 comprises a tension detector 91 disposed within the running path of the linear body 10. The tension detector 91 actually measures the tension of the linear body 10, whereby the accurate tension of the linear body 10 can be detected. As the tension signal outputted from the tension detector 91 is fed back to the motor controller 6, the tension of the running linear body 10 can be controlled accurately.

Though the tension control apparatus in accordance with the first to fifth embodiments are installed at the discharge section for the linear body 10, without being restricted thereto, the present invention also encompasses those installed at the feed section for the linear body 10.

As explained in the foregoing, the following effects can be obtained in accordance with the present invention.

Namely, by simply moving a dancer roller, without employing a complicated mechanism or the like, the tension applied to the linear body can be easily increased or decreased, thus allowing tension control to be performed.

In the foregoing explanation, no restriction has been made concerning the linear body to which tension is applied. This is because the present invention is applicable to tension control apparatus for various kinds of linear bodies such as optical fiber, metal lines like electric wire, and spun yarn. In particular, the present invention can be effectively employed in the fields requiring particularly precise tension control, e.g., in the case where a multifiber cable is made.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A tension control apparatus comprising at least two guide rollers, at least one dancer roller disposed so as to be movable relative to said guide rollers for applying a predetermined amount of tension to a linear body wound about said guide rollers and dancer roller, tension control means for holding said dancer roller and moving said dancer roller along a predetermined line which does not cross a vertical line extending from said guide rollers so as to control the tension applied to said linear body by adjusting an angle between a vertical line and a line connecting respective rotational centers of said guide rollers and dancer roller.

2. A tension control apparatus according to claim 1, wherein said tension control means moves said dancer roller by adjusting a difference between feeding and discharging speeds of said linear body.

3. A tension control apparatus according to claim 1, wherein said tension control means moves said dancer roller along a horizontal line.

4. A tension control apparatus according to claim 1, wherein said tension control means moves said dancer roller along a vertical line.

5. A tension control apparatus according to claim 1, wherein said tension control means moves said dancer roller along an arc.

6. A tension control method in which a linear body is wound about at least two guide rollers and at least one dancer roller movably disposed relative to said guide rollers so as to apply a predetermined amount of tension to said linear body, said method comprising:

variably controlling the tension applied to said linear body by moving said dancer roller along a predetermined line which does not cross a vertical line extending from said guide rollers to adjust an angle between a vertical line and a line connecting respective rotational centers of said guide rollers and dancer roller.

7. A tension control method according to claim 6, wherein said variably controlling includes adjusting a difference in feeding and discharging speeds of said linear body so as to move said dancer roller.

8. A tension control method according to claim 6, wherein said variably controlling includes moving said dancer roller along a horizontal line.

9. A tension control method according to claim 6, wherein said variably controlling includes moving said dancer roller along a vertical line.

10. A tension control method according to claim 6, wherein said variably controlling includes moving said dancer roller along an arc.

* * * * *